United States Patent [19]

Nishizawa

[11] Patent Number: 5,009,241

[45] Date of Patent: Apr. 23, 1991

[54] APPARATUS FOR WASHING NARROW NECK BOTTLES

[76] Inventor: Hideyuki Nishizawa, 1-5-1 Nakazato, Kita-ku, Tokyo, Japan

[21] Appl. No.: 529,741

[22] Filed: May 22, 1990

Related U.S. Application Data

[63] Continuation of Ser. No. 139,348, Dec. 29, 1987, abandoned.

[30] Foreign Application Priority Data

Dec. 29, 1986 [JP] Japan ..... 61-312360

[51] Int. Cl.[5] ..... B08B 3/02; B08B 9/08

[52] U.S. Cl. ..... 134/102; 134/171

[58] Field of Search ..... 134/102, 171, 166 R, 134/169 R; 239/311, 318; 261/DIG. 75; 169/15

[56] References Cited

U.S. PATENT DOCUMENTS

| | | | |
|---|---|---|---|
| 1,978,721 | 10/1934 | Perkins | 134/102 X |
| 2,222,676 | 11/1940 | Mahler | 134/171 |
| 2,366,354 | 1/1945 | Robbins | 261/DIG. 75 |
| 2,564,060 | 8/1951 | Gettins | 261/DIG. 75 |
| 2,811,975 | 11/1957 | Tatibana | 134/102 |
| 4,099,674 | 7/1978 | Standley | 134/171 X |
| 4,406,298 | 9/1983 | Martin | 134/171 X |

FOREIGN PATENT DOCUMENTS

| | | | |
|---|---|---|---|
| 1077818 | 5/1954 | France | 134/171 |

*Primary Examiner*—Philip R. Coe
*Attorney, Agent, or Firm*—David O'Reilly

[57] ABSTRACT

A narrow neck bottle is washed and rinsed by a method comprising the steps of supporting the bottle in an upside down position, injecting water containing air bubbles, into the bottle through a tube extending through the narrow neck of the bottle, accumulating air released from the poured water in an upper space in the bottle and expelling air and water remaining in the bottle by the accumulated air. Apparatus for carrying out this method comprises an aspirator installed such that its discharge pipe is directed upwardly, and connected to the discharge pipe, and a support for supporting the narrow neck bottle such that when supported by the support, the narrow neck of the bottle engages against the tube and that a gap is formed between the inner bottom surface of the bottle and the free end of the tube.

2 Claims, 3 Drawing Sheets

APPARATUS FOR WASHING NARROW NECK BOTTLES

This is a continuation of co-pending application Ser. No. 07/139,348 filed on Dec. 29, 1987, and now abandoned.

FIELD OF THE INVENTION

This invention relates to method and apparatus for quickly and positively washing such narrow neck bottles as narrow neck vessels utilized in chemical experiments and measuring flasks utilized for chemical analysis or the like.

BACKGROUND OF THE INVENTION

Bottles utilized for chemical purpose are required to be thoroughly washed and rinsed before their use for the purpose of preventing contamination caused by impurities. The washing of narrow neck bottles is done by washing the interior of the bottle with a brush and a detergent, and then rinsing with clean water for several times. However, in a narrow neck bottle, discharge of the water poured therein is not easy because of its narrow neck, so that much time and labor are required before the interior of the bottle becomes clean enough, without any residue of the detergent. This requires substantial rinsing.

However, since washing the outer surface of the bottle is relatively easy, a method of readily washing the interior of the bottle has been proposed. More particularly, the washing of the outer surface of the bottle can readily be performed by causing the water to flow down along the outer surface. Such washing is easier than the washing of the interior. The proposed method of washing the interior is based on the same phenomenon, that is to cause the water to flow down along the inside surface of the bottle.

According to this method, a tube is inserted into the neck of an inverted bottle, and water is injected upon the bottom surface of the interior of the bottle through the tube. However, the bottle to be rinsed is in a state immediately after washing with a brush and detergent such that the interior of the bottle is filled with the foam resulting from this method. Even though the water flows down along the inner surface of the bottle in the form of a thin film, the foam can not be removed readily, thus failing to rapidly and readily rinse the bottom of the bottle.

This is caused by the fact that although the water poured into the bottle flows along the inner surface in the form of a thin film, the water flows out without entrapping the foam therein, and residual water remains in the bottle so that at the time of injecting the rinsing water, the air in the bottle is entrapped in the rinsing water, thereby forming new foam with the detergent.

SUMMARY OF THE INVENTION

Accordingly, it is an object of this invention to provide a novel method and apparatus capable of rapidly and positively washing and rinsing the interior of a narrow neck bottle with a small quantity of washing and rinsing water.

According to one aspect of the invention, there is provided a method of washing a narrow neck bottle comprising the step of supporting the bottle in an upside-down position, injecting water containing air bubbles into the bottle through a tube, accumulating air released from the poured water in the upper space in the bottle, and pushing out air and water remaining in the bottle by the accumulated air.

According to another aspect of this invention there is provided apparatus for washing a narrow neck tube comprising an aspirator installed such that its discharge pipe is directed upwardly, a tube connected to the discharge pipe, and means for supporting the narrow neck bottle such that when supported by the supporting means the narrow neck of the bottle engages the tube and a gap is formed between the inner bottom surface of the narrow neck bottle and the free end of the tube.

According to a modified embodiment of this invention there is provided apparatus for washing narrow neck bottles comprising a base, a plurality of washing pipes mounted on the base, a water feed pipe mounted on the base and communicated with respective washing pipes, an air admitting pipe connected to the water feed pipes and provided with a plurality of openings distributed in a circumferential direction of the air admitting pipe, an operating water supply pipe connected to the upper end of the air admitting pipe and provided with a laterally extending operating water supply member, the upper end of the operating water supply pipe being positioned above the upper ends of the washing pipes, the upper end of the operating water supply pipe being formed with an inner opening which has a small diameter portion, an intermediate diameter portion, and a large diameter portion, which are sequentially formed in that order from the lower portion.

DESCRIPTION OF THE PREFERRED EMBODIMENT

Figure 1:
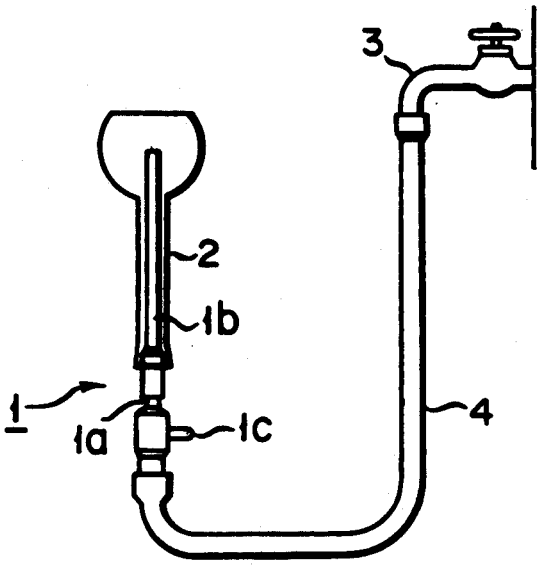
FIG. 1 is a front view of a first embodiment of this invention.

A preferred embodiment of this invention diagrammatically shown in FIG. 1 comprises an aspirator 1 with its water discharge pipe 1*a* supported vertically, the upper end of the pipe 1*a* being opened. The neck of a narrow neck bottle 2 (in this case, a measuring flask) is connected to discharge pipe 1*a* of the aspirator and supported by a soft tube 1*b* made of vinyl or the like. The aspirator has an air suction port 1*c* and is connected to a bib cock 3 of a water supply through a hose 4.

In the apparatus described above, since the aspirator is not used for decreasing the air pressure in the bottle, it is not necessary to construct the suction pipe 1*c* to be hermetically closable. Therefore instead of forming a transverse air intake pipe as in a conventional aspirator, an opening may be provided for the side wall of the discharge pipe 1*a*.

With the construction described above, the water injected into bottle 2 through tube 1*b* connected to the discharge pipe 1*a* contains a large quantity of air bubbles. The water supplied to the inner bottom portion of the bottle (which is supported upside down) flows down along the inner surface 1*f* of the bottle while releasing the air bubbles, then providing strong washing and rinsing effects. The air thus released accumulates in the upper portion of the inverted bottle for pushing out or discharging the air and water remaining in the bottle. Since the water does not remain in the bottle there is no fear of forming new bubbles with the detergent.

For this reason, washing and rinsing with flowing water of the interior of a bottle can be made under the same or better conditions than the washing and rinsing of the outer surface. Thus it becomes possible to clean the interior of a narrow neck bottle in a much shorter time and with less labor than a method of cleaning in which filling and discharge of water into and out of the bottle are alternately repeated. As can be noted from the above description, while using the washing apparatus shown in FIG. 1, it is not necessary to hold the bottle with the hand.

It will be clear that the means for admixing air with washing water to be injected into the bottle is not limited to the illustrated aspirator, and that any other suitable means can be used.

Figure 2:
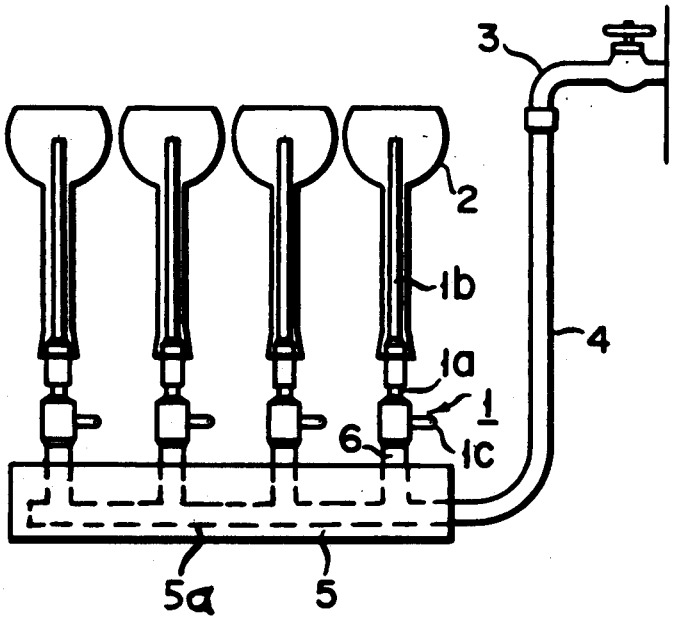
FIG. 2 is a front view showing a second embodiment of this invention.

FIG. 2 shows a side view of a modified embodiment of this invention in which a plurality of the washing apparatus shown in FIG. 1 are juxtaposed, and elements corresponding to those shown in FIG. 1 are designated by the same reference numerals, More particularly in the modification shown in FIG. 2, a header, indicated at 5*a* provided with four vertical branches 6 is contained in a base 5. Water supply pipes of respective aspirators 1 are connected to branches 6. The header is connected to bib cock 3 via a hose 4. With this modified embodiment, when the necks of the bottles 2 are connected to the tubes 1*b* of respective aspirators 1 it is possible quickly and readily to wash and rinse four bottles at a time. It should be understood that the number of aspirators is not limited to four.

Figure 3:
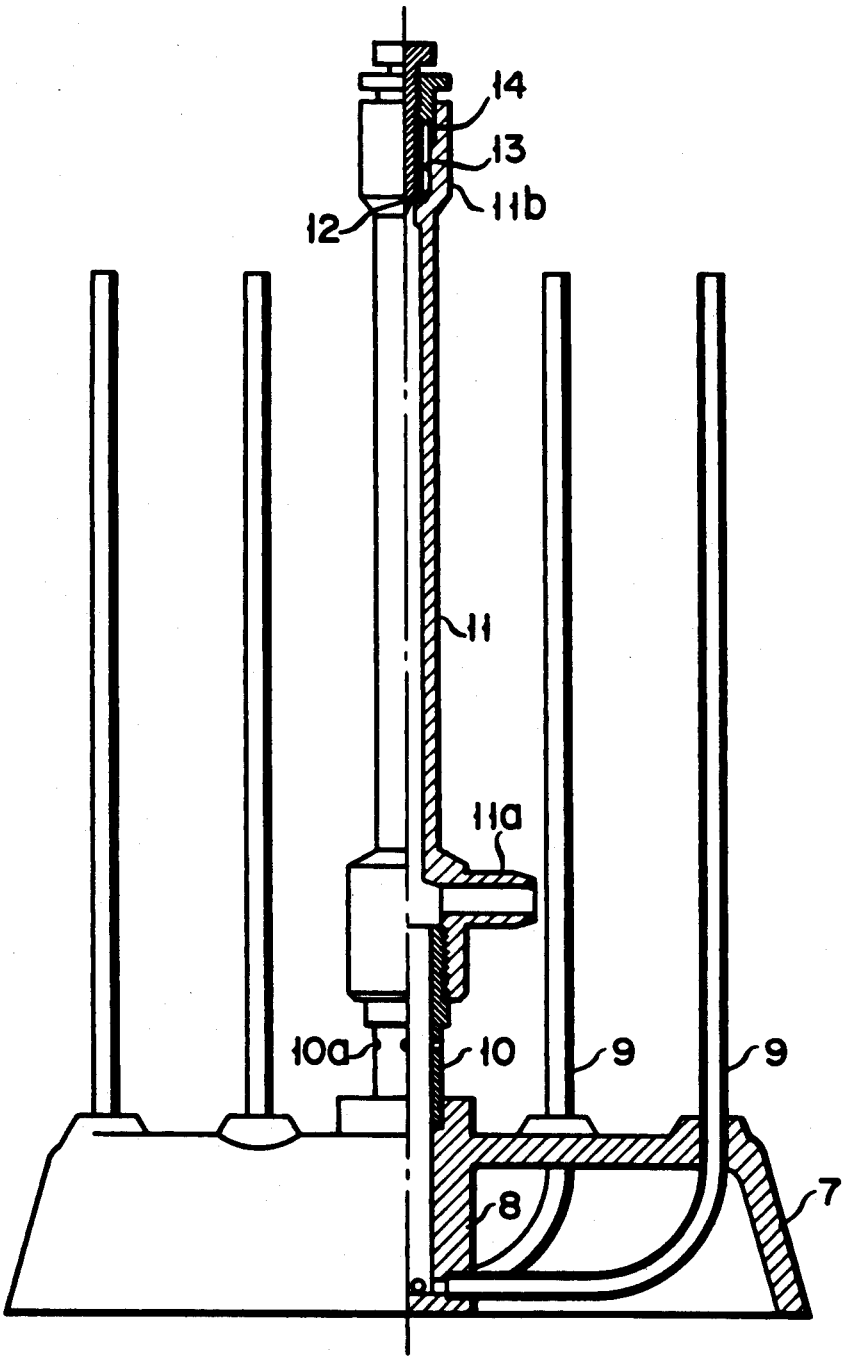
FIG. 3 is a front view, partly in section, showing a third embodiment of this invention.

FIG. 3 shows still another embodiment of this invention wherein a vertical feed water pipe 8 is provided at the center of a frustoconical base 7, and the bottom end of the feed water pipe 8 is connected to the lower ends of a plurality of washing pipes 9 which are located at an equal distance in the peripheral direction of the pipe 8. To the upper end of the feed water pipe 8 is connected an air admixing pipe 10 having a plurality of openings 10*a* equally spaced in the circumferential direction.

Figure 4A:
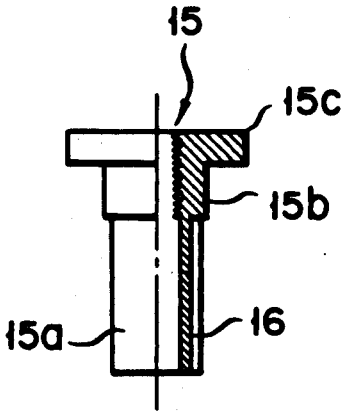
FIG. 4A is a front view, partly in section, showing a water film forming cylinder.
Figure 4B:
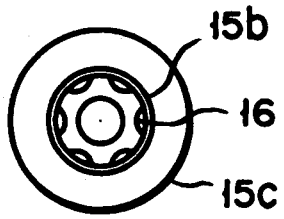
FIG. 4B is a bottom view of the water film forming cylinder shown in FIG. 4A.
Figure 5B:
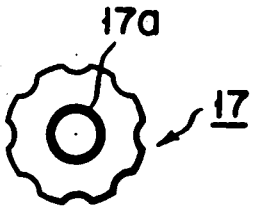
FIG. 5B is a bottom view of the needle valve shown in FIG. 5A

A vertical operating water supply pipe 11 having a laterally extending water inlet pipe 11*a* is connected to the air admixing pipe 10. The upper end of the operating water supply pipe 11 is located above the upper ends of washing pipes 9. The diameter of the upper end of operating water supply pipe 11 is increased to provide an enlarged diameter portion 116 having an inner hole in which are formed a small diameter portion 12 acting as a valve seat of a needle valve to be described later. An intermediate diameter portion 13 is adapted to receive a water film forming cylinder to be described later, and a larger diameter portion 14 adapted to receive the neck portion of the water film forming cylinder with a small gap therebetween. As shown in FIGS. 4A and 4B, the water film forming cylinder 15 has a diameter snugly fitted in the intermediate diameter portion 13. It comprises a body portion 15*c* provided with a plurality of vertical grooves 16 equally spaced in the circumferential direction, a neck portion 15*b* having a diameter slightly larger than that of the body portion 15*c* for defining a small gap between the neck portion of the large diameter portion 14 of the inner hole, and a knob 15*c* connected to the neck portion.

Figure 5A:
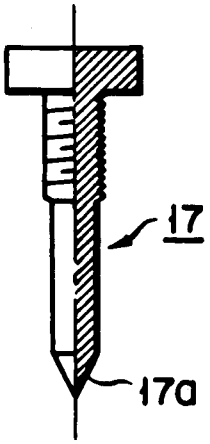
FIG. 5A is a front view, partly in section showing a needle valve.

As shown, needle valve 17 is threaded into the water film forming cylinder 15. The conical portion 17*a* (see FIG. 5A) at the lower end cooperates with the small diameter portion of the inner hole 12 to act as a valve.

With this embodiment, the water inlet port 11*a* is connected to a bib cock at the water supply through a hose for supplying water to the operating water supply pipe 11. Then a portion of the supplied water flows downwardly and the other portion flows upwardly. The downwardly flowing water entraps air sucked through opening 10*a* of the air admixing pipe 10 and is then supplied to respective washing pipes through the feed water pipe 8.

The upwardly flowing water flows to the grooves 16 of the main body 15*a* of the water film forming cylinder 15 via the gap of the needle valve 17 and then sprinkles in the form of a water film through the gap formed between the neck portion 15*b* and the large diameter portion 14 of the inner hole.

The narrow neck bottles to be washed and rinsed are held upside-down by engaging their necks with the washing pipes. The bottles are supported by a supporting device, not shown, with air caps between the bottom surfaces of respective narrow neck bottles and the tips of the washing pipes 9. As the supporting device is used a pinch cock, for example that can move along the washing pipes 9.

As described above, since the water supplied in the washing pipes 9 is admixed with air, washing and rinsing of the interior of the bottles can be readily and rapidly made just like the embodiments shown in FIGS. 1 and 2.

The water sprinkled in the form of a thin film washes the outer surface of the inverted bottle, and the quantity of the sprinkled water is adjusted by the needle valve 17.

It should be understood that the invention is not limited to the embodiments described above. For example, a mechanism for automatically rotating the bottles being washed and rinsed for effecting uniform and rapid washing is also useful.

As above described according to the method and apparatus of this invention it is possible to effect rapid and positive rinsing after a washing using a detergent, and since the water used for washing and rinsing contains a substantial quantity of air bubbles, effective washing and rinsing can be accomplished with a small quantity of water, which is economical.

For the sake of simplicity, in the appended claims the term "washing" is used to mean both washing and rinsing.

What is claimed is:

1. Apparatus for washing narrow neck bottles comprising:

a base having a header with a plurality of vertical branches;

water supply hose means connected to said header to supply water to said vertical branches of said header;

a plurality of aspirator means each having an intake end and an outlet end, there being one of said aspirator means connected to each of said branches, its inlet end being so connnected; each said aspirator mean comprising a vertical discharge pipe with an air suction port entering into said vertical discharge pipe from atmosphere so as to provide air for entrainment into water flowing through said discharge pipe;

a vertical tube connected to the outlet end of each of said aspirator pipes;

whereby bottles can be mounted inverted one each of said vertical tubes and washed by water discharged through said aspirator, which water contains a substantial quantity of air bubbles entrained from said air suction port.

2. The apparatus according to claim 1 in which vertical tubes are constructed of a soft vinyl to prevent damage to the narrow neck of said bottles.

* * * * *